US009618297B2

(12) United States Patent
Axelsson

(10) Patent No.: US 9,618,297 B2
(45) Date of Patent: Apr. 11, 2017

(54) GAS POWERED GUN WITH VELOCITY REGULATOR

(71) Applicant: FX AIRGUNS AB, Mariestad (SE)

(72) Inventor: Fredrik Axelsson, Mariestad (SE)

(73) Assignee: FX AIRGUNS AB, Mariestad (SE)

( * ) Notice: Subject to any disclaimer, the term of this patent is extended or adjusted under 35 U.S.C. 154(b) by 0 days.

(21) Appl. No.: 15/057,281

(22) Filed: Mar. 1, 2016

(65) Prior Publication Data

US 2016/0258711 A1 Sep. 8, 2016

(30) Foreign Application Priority Data

Mar. 2, 2015 (EP) ..... 15157145

(51) Int. Cl.
*F41B 11/723* (2013.01)
*F41B 11/62* (2013.01)

(52) U.S. Cl.
CPC ..... *F41B 11/723* (2013.01); *F41B 11/62* (2013.01)

(58) Field of Classification Search
CPC ..... F41B 11/72–11/724; F41B 11/62; B25C 1/00–1/188
See application file for complete search history.

(56) References Cited

U.S. PATENT DOCUMENTS 5,280,778 A * 1/1994 Kotsiopoulos ..... F41A 19/02 124/31
7,765,997 B2 8/2010 Klöckener et al.
8,413,644 B2 * 4/2013 Masse ..... F41B 11/62 124/73
2003/0106545 A1 6/2003 Verini

FOREIGN PATENT DOCUMENTS

DE 20214533 U1 12/2002
DE 202006018601 U1 2/2007

OTHER PUBLICATIONS

European Search Report issued in European Application No. 15157145.2, dated Feb. 27, 2015, which the instant application claims priority to; 5 pgs.

* cited by examiner

*Primary Examiner* — Stephen M Johnson
*Assistant Examiner* — Joshua Semick
(74) *Attorney, Agent, or Firm* — Harness, Dickey & Pierce, P.L.C.

(57) ABSTRACT

A gas powered gun comprising a valve arranged to exhaust compressed gas from a chamber to thereby discharge a projectile inside a barrel, and a hammer arranged to be cooperate with a valve opening arrangement to thereby open the valve. A spring is arranged between the hammer and a spring abutment for spring loading the hammer. The gun further comprises an adjustment knob turnable around an axis A of rotation, substantially perpendicular to the spring loading direction. The knob has a cam surface having a varying radial distance from the axis of rotation, and a follower, integrated with the spring abutment, is pressed by the spring to rest against the cam surface. When the adjustment knob is turned, the follower will slide against the cam surface and move the follower and the spring abutment in the spring loading direction, to thereby adjust a pretension of the spring.

10 Claims, 7 Drawing Sheets

GAS POWERED GUN WITH VELOCITY REGULATOR

CROSS-REFERENCE TO RELATED APPLICATION

This application claims the benefit of, and priority to, European Patent Application No. 15157145.2 filed Mar. 2, 2015. The entire disclosure of the above application is incorporated herein by reference.

FIELD OF THE INVENTION

The present invention relates to a gas powered gun having a valve arranged to exhaust compressed gas from a chamber to thereby discharge a projectile inside a barrel, a hammer arranged to be cooperate with a valve opening arrangement to thereby open the valve, a spring abutment, and a spring arranged between the hammer and the spring abutment and arranged to spring load the hammer in a spring loading direction towards the valve opening arrangement.

BACKGROUND OF THE INVENTION

Gas powered guns of the above mentioned kind are well known in the art, and the compressed gas may be e.g., air (air guns).

The tension of the spring will determine the force of the hammer, and thus the time during which the valve is open. The stronger the spring force, the longer the valve will stay open, and the more gas will be exhausted into the barrel. And the more air, the higher speed of the discharged projectile.

Therefore, it is known to adjust the tension of the spring, typically by moving the spring abutment against which the spring rests. Typically such adjustment requires specific tools, and is only done during manufacturing.

However, there is an increased need or desire to provide more simple adjustment of the discharge speed.

General Disclosure of the Invention

This and other objects are achieved by a gas powered gun for discharge of projectiles, comprising a valve arranged to exhaust compressed gas from a chamber to thereby discharge a projectile inside a barrel, a hammer arranged to be cooperate with a valve opening arrangement to thereby open the valve, a movable spring abutment, and a spring arranged between the hammer and the spring abutment and arranged to spring load the hammer in a spring loading direction towards the valve opening arrangement. The gun further comprises an adjustment knob including a gripping portion, allowing a user to grip the adjustment knob and to turn the adjustment knob around an axis of rotation, the axis of rotation being substantially perpendicular to the spring loading direction, and a cam surface extending around the axis of rotation and having a varying radial distance from the axis of rotation, and a follower, integrated with the spring abutment and pressed by the spring in the spring loading direction to rest against the cam surface, so that, when the adjustment knob is turned, the follower will slide against the cam surface and move the follower and the spring abutment in the spring loading direction, to thereby adjust a pretension of the spring According to the invention, the spring abutment, and thus the compression of the spring, can be easily adjusted by turning the knob. More specifically, depending on the rotational position of the knob, the portion of the cam surface facing the follower will have a different distance to the axis of rotation, and the follower, which is pressed against the cam surface, will thus assume a different position in the spring loading direction. As the abutment is attached to the follower, also the position of the abutment will be changed. The position of the abutment will determine a distance between the abutment and the hammer, and thus the compression of the spring. The compression of the spring will determine the force of impact of the hammer on the valve opening arrangement, which in turn will determine the duration of time during which the valve is open. The longer the valve is open, the more compressed gas will enter the barrel, and the higher the velocity of the discharged bullet will be.

The expression "coupled with" is intended to include all designs where movement of the follower will lead to movement of the abutment. For example, the abutment and follower may integrally formed as one single element. They may also be formed as two elements, fixedly attached to each other. More complex alternatives are also possible, where the follower and abutment are mechanically linked by intermediate members.

The knob is preferably arranged so as to be easily accessible from outside the gun, i.e. without requiring any dismantling of the gun or any special tools.

The cam surface may be the mantle surface of a cylindrical portion formed with a center axis in parallel and at a distance from the axis of rotation. This is a simple and effective way to design and manufacture a knob with a cam surface according to the invention. It means that the cylindrical portion is asymmetrically arranged around the axis of rotation of the knob.

The knob can be lockable in predefined positions, each position associated with a specific portion of the cam surface facing the follower, each cam surface portion having a specific distance to the axis of rotation. This makes it very easy for a user to select a desired velocity by turning the knob to one of the positions. For example, the knob may include a plurality of indentations in a surface facing the gun, and a spring loaded rounded surface arranged to slide against the surface and to engage one of the indentations, to thereby lock the knob in one of the plurality of predefined positions.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise.

BRIEF DESCRIPTION OF THE DRAWINGS

The above, as well as additional objects, features and advantages of the present disclosure, will be better understood through the following illustrative and non-limiting detailed description of currently preferred embodiments of the present invention, with reference to the appended drawings, where the same reference numerals will be used for similar elements.

DETAILED DESCRIPTION OF PREFERRED EMBODIMENTS

Embodiments of the present disclosure will be described in more detail in the following with reference to the accompanying drawings. All the figures are highly schematic, not necessarily to scale, and they show only parts which are necessary in order to elucidate the invention, other parts being omitted or merely suggested.

Figure 1A:
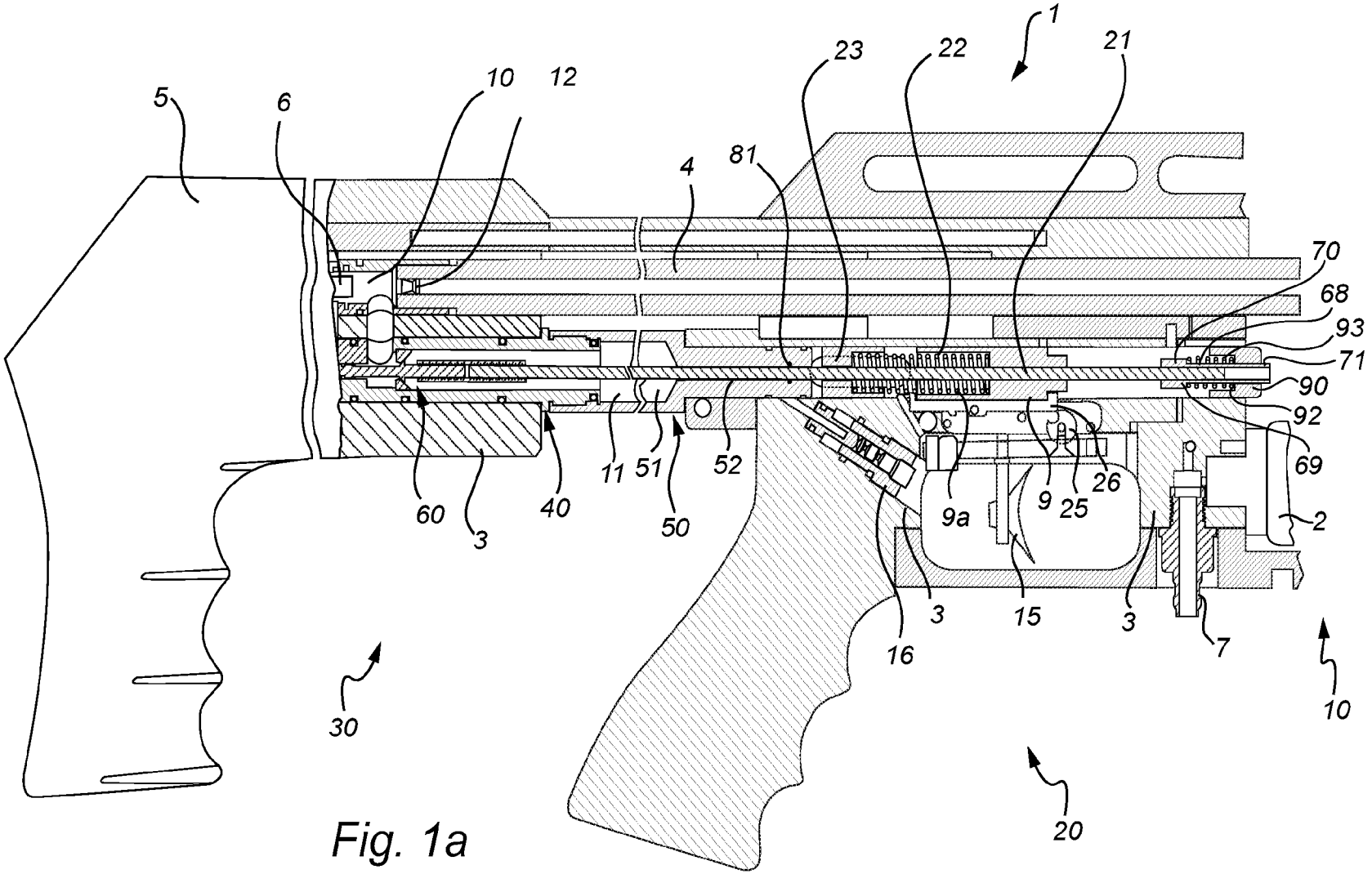
FIG. 1*a* is a cross section of a portion of an air gun according to an embodiment of the present invention, in a ready-to-fire state.
Figure 1B:
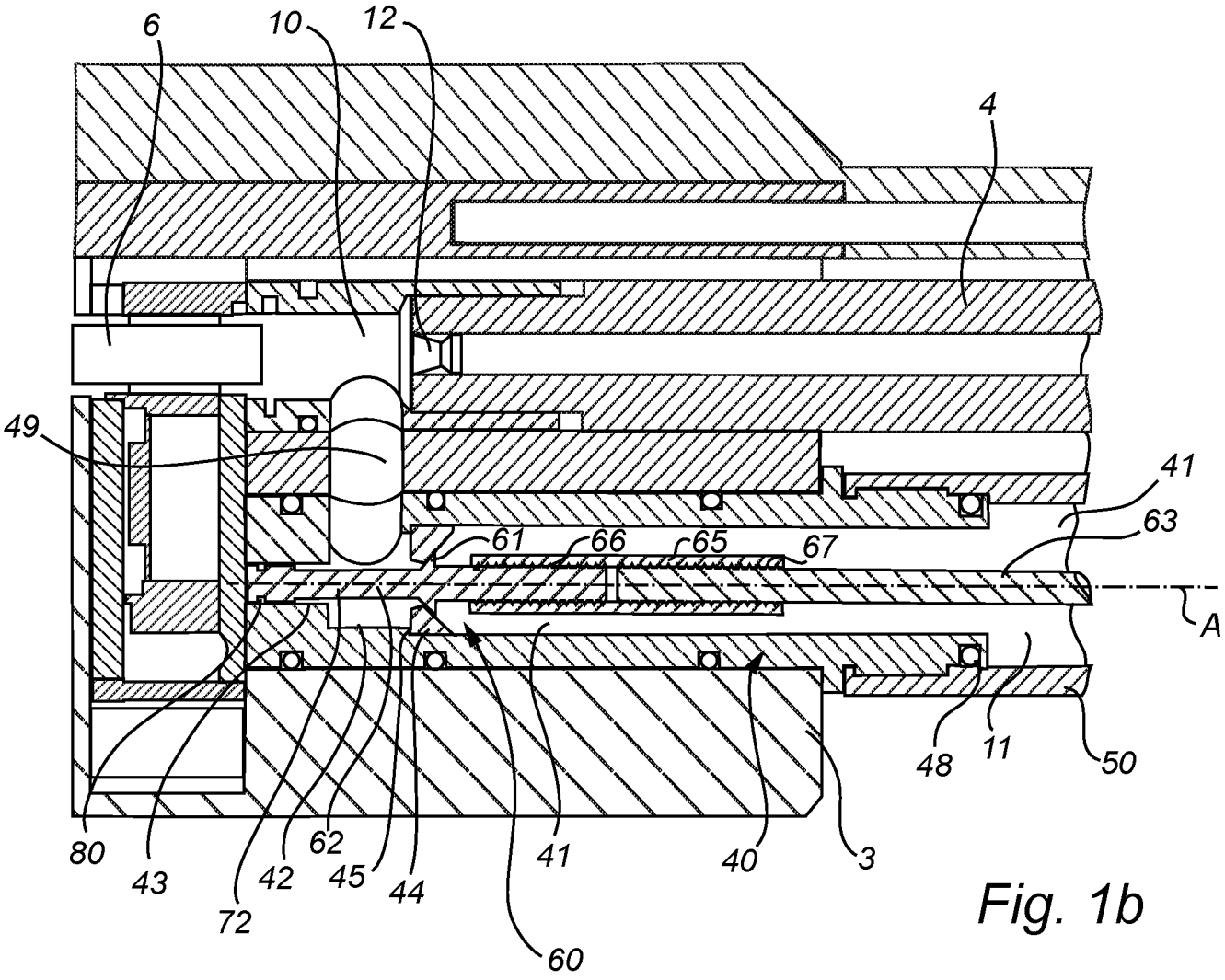
FIG. 1*b* is a more detailed cross section of the rear portion of the gun in FIG. 1*a*.
Figure 2A:
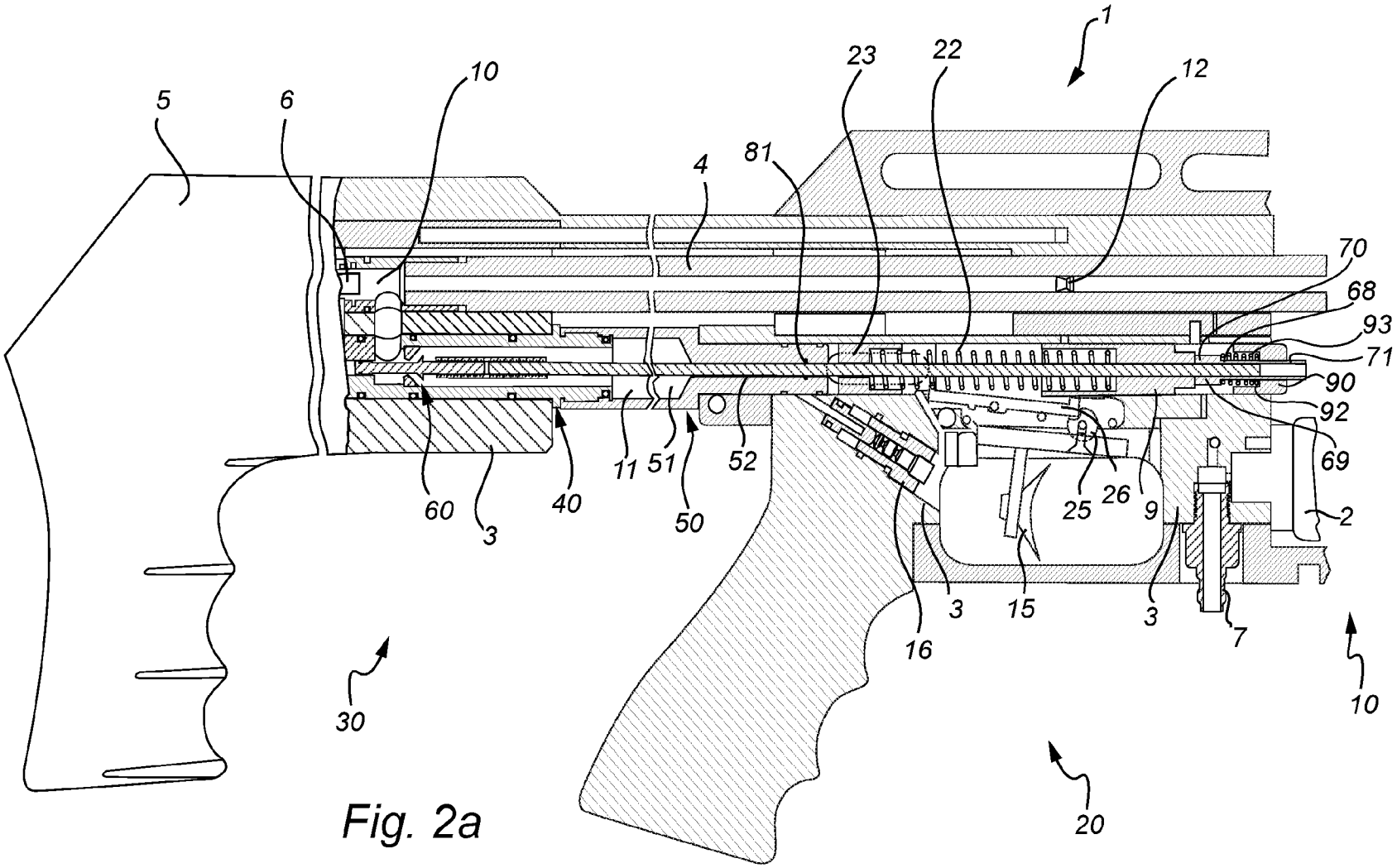
FIG. 2*a* is a cross section of the portion in FIG. 1*a*, after the trigger has been activated.
Figure 2B:
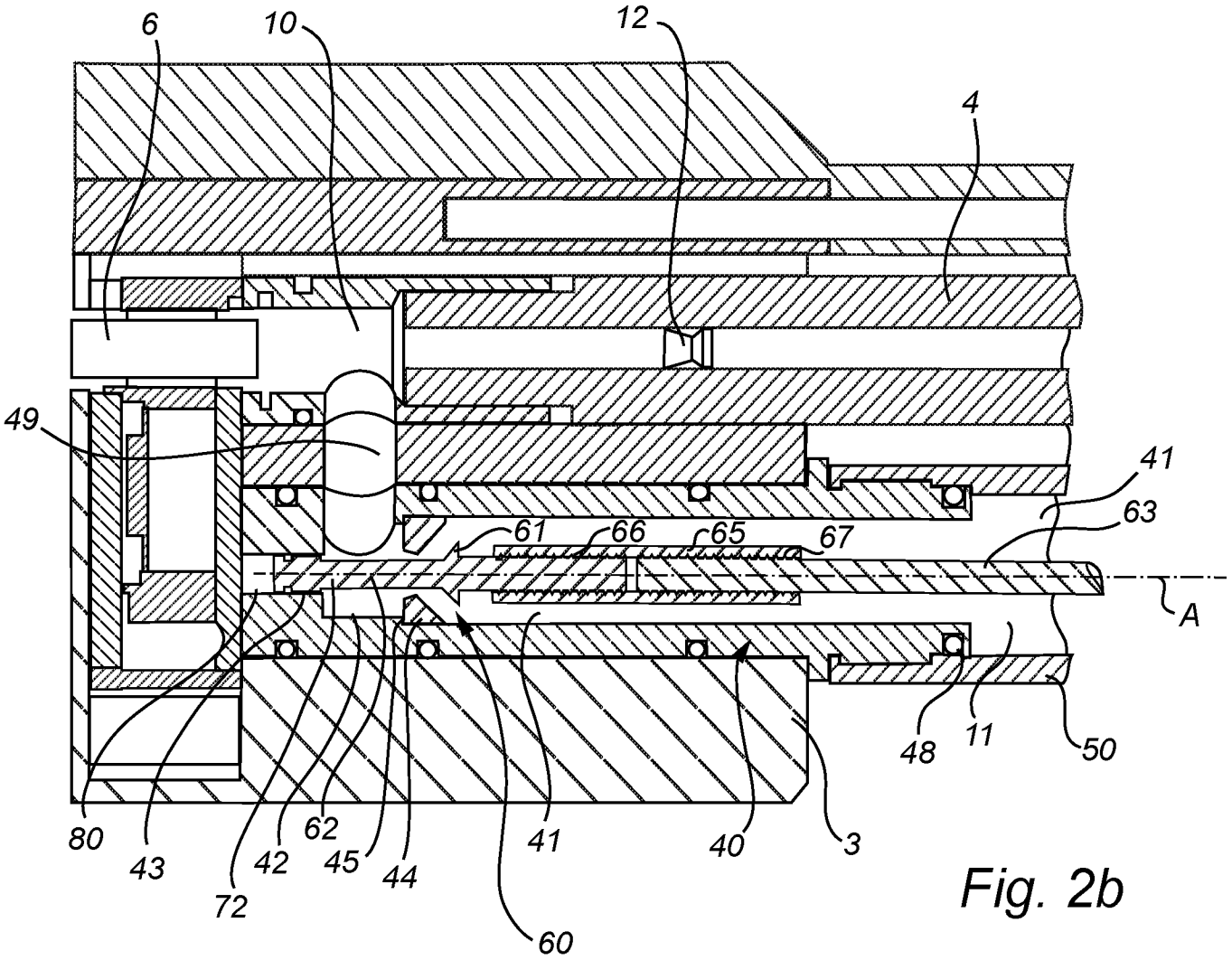
FIG. 2*b* is a more detailed cross section of the rear portion of the gun in FIG. 2*a*.

FIGS. 1*a*, 1*b*, 2*a*, 2*b* show a gas powered gun 1. FIGS. 1*a* and 1*b* show the gun in a ready-for-fire-position, while FIGS. 2*a* and 2*b* show the gun after the trigger has been activated. The same reference numerals have been used to indicate identical elements in all drawings 1*a*, 1*b*, 2*a*, 2*b*. In the following description, the expressions front and rear relate to the normal firing direction of the gun, and consequently "rear" is to the left in FIG. 1*a*, while "front" is to the right in FIG. 1*a*.

The portion of the gun 1 shown in FIGS. 1*a*, 2*a* comprises a front portion 10, where a container 2 of compressed air or other gas is fitted to the body 3 of the gun 1. A connector 7 is arranged between the bottle 2 and the gun 1 and it is used to fill the bottle 2 with gas. The gun 1 also has a rear portion 30, where a butt 5 is fitted to the body 3, and a central portion 20 between the front portion 10 and the rear portion 30. A barrel 4 is fitted in the body 3 so as to extend from the rear portion 30 through the central and front portions 20 and 10. The front end of the barrel 4 is not shown in the figures.

A feeder pin 6 is slidably arranged in the body 3 immediately behind the rear end 4*a* of the barrel 4. The feeder pin 6 is arranged to push a projectile e.g., in the form of a diabolo bullet 12, from a magazine (not shown) into the barrel 4. The feeder pin 5 is arranged to be slid back and then to be slid forward, in order push a projectile e.g., in the form of a diabolo bullet 12, from a magazine (not shown) into a firing position in the barrel 4, as shown in FIGS. 1*a* and 1*b*.

The compressed gas from the container 2 is fed to a pressure chamber 11. The pressure chamber 11 is an elongated chamber which extends from rear portion 30 towards the central portion 20 of the gun 1. The gun 1 further comprises an open-close valve 60, which is arranged in the rear end of the pressure chamber 11. In its closed state, the valve 60 seals the pressure chamber 11. In its open state, the valve allows passage of compressed gas from the bottle 2 to a space 10 immediately behind the bullet 12 in the barrel 4.

As will be described in more detail below, the valve 60 is opened by a valve opening arrangement cooperating with a spring loaded hammer 9, which is released by a trigger 15. When the valve 60 is opened, compressed air from the chamber 11 is exhausted into the space 10 behind the bullet 12 and "fires" the bullet 12.

The gun 1 may also comprise a gas regulator 16, which also is arranged at the central portion 20 of the gun 1. A regulator is a mechanical device, i.e. a valve that controls the air pressure in the pressure chamber 11. A passage (not shown) in the gun body 3 forwards the gas from the container 2 into the regulator 16, which forwards the gas into the pressure chamber 11 and regulates the gas pressure in the pressure chamber 11. This means that the pressure is always the same and hence an airgun with a regulator shoots with very consistent velocity.

The pressure chamber 11 is here formed by a rear hollow cylinder portion 40, and a front hollow cylinder portion 50 sealingly joined together to a continuous cylindrical compartment. In the illustrated example, the rear end of the front hollow cylinder portion 50 threadedly engages the front end of the rear hollow cylinder portion 40. A sealing member 48, e.g. an o-ring, is arranged to seal between the two cylinder portions 40, 50.

With reference to FIG. 1*b*, the rear hollow cylindrical portion 40 comprises a front portion 41 in its front end, a middle portion 42 immediately behind the pressure chamber, and a rear portion 43 in its rear end. The rear portion 43 has an inner diameter which is smaller than the inner diameter of the middle and front portions 42, 41. Preferably, the inner diameter of the middle portion 42 is slightly smaller than the inner diameter of the front portion 41. The front hollow cylindrical portion 50 comprises a rear portion 51 and a front portion 52. The inner diameter of portion 51 is larger than the inner diameter of portion 52.

The front portion 41 of the rear hollow cylindrical portion 40 and the rear portion 51 of the front hollow cylindrical portion together form the pressure chamber 11. The middle portion 42 is in fluid connection with the space 10 via a channel 49 extending perpendicularly to the centre axis A of the pressure chamber 11.

With continued reference to FIG. 1*b*, the open-close valve 60 comprises a valve seat 44 arranged between the front and middle portions 41, 42 of the rear hollow cylindrical portion 40. The valve seat 44 may be arranged to abut against an annular step 45 formed by any difference in inner diameters. The valve 60 further comprises a valve head 62 which has an annular flange 61 arranged to cooperate with the valve seat 44.

The valve head 62 is here arranged in front of the valve seat 44, and is arranged at one end of a rod 63. The rod 63 forms an elongated extension of the valve head essentially in the longitudinal direction A towards the front of the gun 1 through the pressure chamber. In the illustrated example, the rod 63 and the valve head portion 62 are interconnected by means of a threaded sleeve 65. More specifically, the rod 63 and the valve head 62 each comprises threaded portions 66, 67 at the ends which shall be connected. The threaded portion 66 of the valve head 62 and the threaded portion 67 of the rod 63 are threadedly engaged to opposite ends of the sleeve 65.

The rear end 72 of the valve head 62 is received in the rear portion 43 of the rear hollow cylinder portion 40, and serves to guide the valve head 62 and the rod 63. The end 72 is further sealed against the inner walls of portion 43, here by means of an O-ring 80. At the front end of the pressure chamber 11 the rod 63 protrudes out of the pressure chamber 11 through the front portion 52 of the front cylinder portion 50. The rod 63 is sealed against the inner walls of the portion 52, here by means of an O-ring 81, in order to seal the front end of pressure chamber 11. It is noted that the diameter of the flange 61 is larger than the diameter of the rod 63 where it seals the pressure chamber 11. A pressure in the pressure chamber will therefore serve to press the valve head 62 against the valve seat 44 to effectively seal the chamber 11.

A hammer cooperating member 68 is connected to the front end of the rod 63. In the illustrated example, the rod 63 comprises at this end a threaded portion 69 which engages a threaded hole in the hammer cooperating member 68. The hammer cooperating member 68 comprises a larger diameter hammer hitting portion 70 and a smaller diameter guiding portion 71.

The guiding portion 71 is received in a support 90. The support 90 comprises a spring abutment, 92. A spring 93 is arranged between this spring abutment 92 and the hammer hitting portion 70 of the hammer cooperating member 68. The spring will serve to press the hammer cooperating member 68 and the extension member 63 in the rearwards direction, to close the valve 60 after the gun has been fired, further described below.

The hammer 9 is arranged between the pressure chamber 11 and the hammer cooperating member 68. In the illustrated example, the hammer 9 has a central though hole 21, through which the extension member 63 passes, to allow the hammer 9 to slide along the extension member 63. In its rear end 9*a*, the hammer has a compartment for receiving one end of a coil spring 22, which is arrange coaxially with the extension member 63. The other end of the coil spring 22 abuts a spring abutment, here in the form of a cylindrical cup 23. The rod 63 passes through a central through hole 24 in the cup 23, allowing relative motion between the rod 63 and the cup 23. The cup 23 is fixed with respect to the frame 3, but its position may be adjustable. A catch 25 engages the lower edge 26 of the hammer 9. The catch 25 is mechanically connected to the trigger 15. The trigger-catch cooperation can be done in many different ways and will not be explained further.

In FIGS. 1*a* and 1*b*, the gun is in a loaded position, i.e. in a ready-for-fire-position. As mentioned above, the feeder pin 6 has been slid into the barrel 4, and fed a bullet 12 into the firing position. The hammer 9 is spring loaded by the spring 22 against the catch 25, and the valve 60 seals the pressure chamber 11. The pressure chamber 11 has been filled with high pressure air from the bottle 2, with a pressure regulated by the regulator 16.

With reference to FIGS. 2*a* and 2*b*, when the hammer 9 is released by actuating the trigger 15, the hammer 9 is forced by the spring 22 into contact with the hammer cooperating member 68. By the impact, the hammer cooperating member 68 will move in the forward direction (to the right in FIG. 2*a*) and the rod 63 and the valve head 62 will move with it. The hammer 9 will thus "pull" the valve head 62 out of sealing contact with the valve seat 44 to thereby allow an exhaust of gas through the channel 49 into the space 10 behind the bullet 12. As a consequence, the bullet 12 will be discharged through the barrel 4.

When the hammer cooperating member 68 is pushed forward by the hammer 9, the spring 93 will be compressed. After impact, the spring 93 will return the hammer cooperating member 68, the rod 63 and the valve seat 62 to their original position (as in FIG. 1*a*, 1*b*), to close the valve 60.

When the bullet has been discharged, the pressure in the pressure chamber 11 will immediately drop and the regulator 16 will allow new gas to flow from the gas bottle 2 into the pressure chamber 11 to bring the pressure back to its regulated value. The pressure in the pressure chamber 11 will press the valve head 62 against the valve seat 44 to tightly seal the pressure chamber 11.

The user may now use a manual handle (not shown) to bring the hammer back against the force of the spring 22 to its ready-to-fire state, where it is again secured by the catch 25.

Figure 3B:
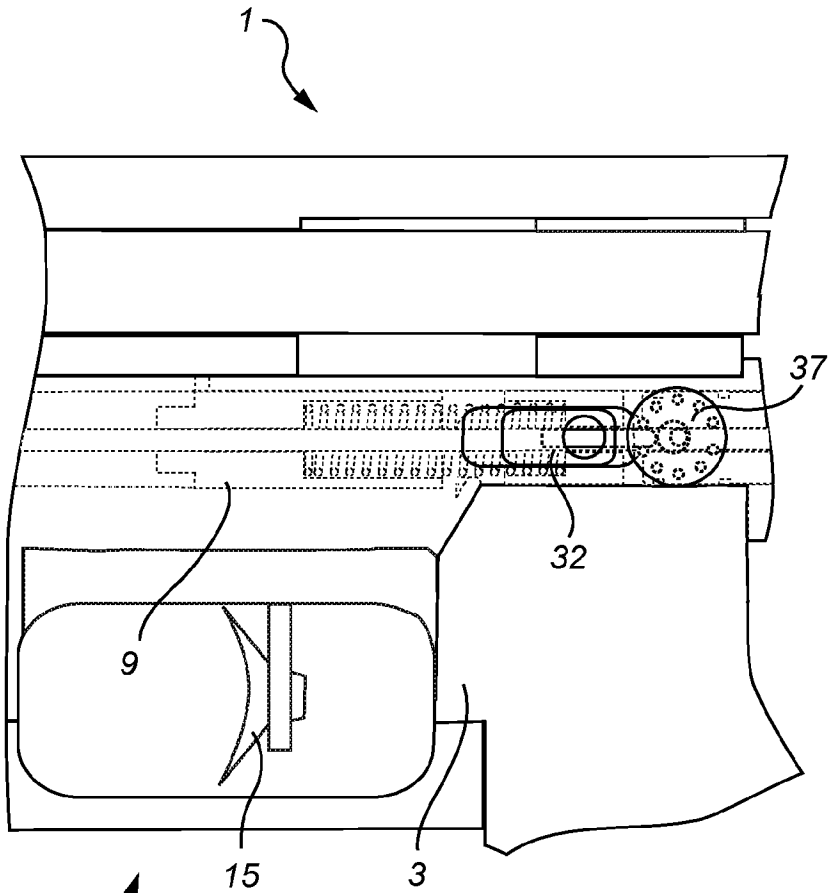
FIG. 3*b* is a side view of the middle portion of the gun in FIG. 1, seen from the opposite side.
Figure 3A:
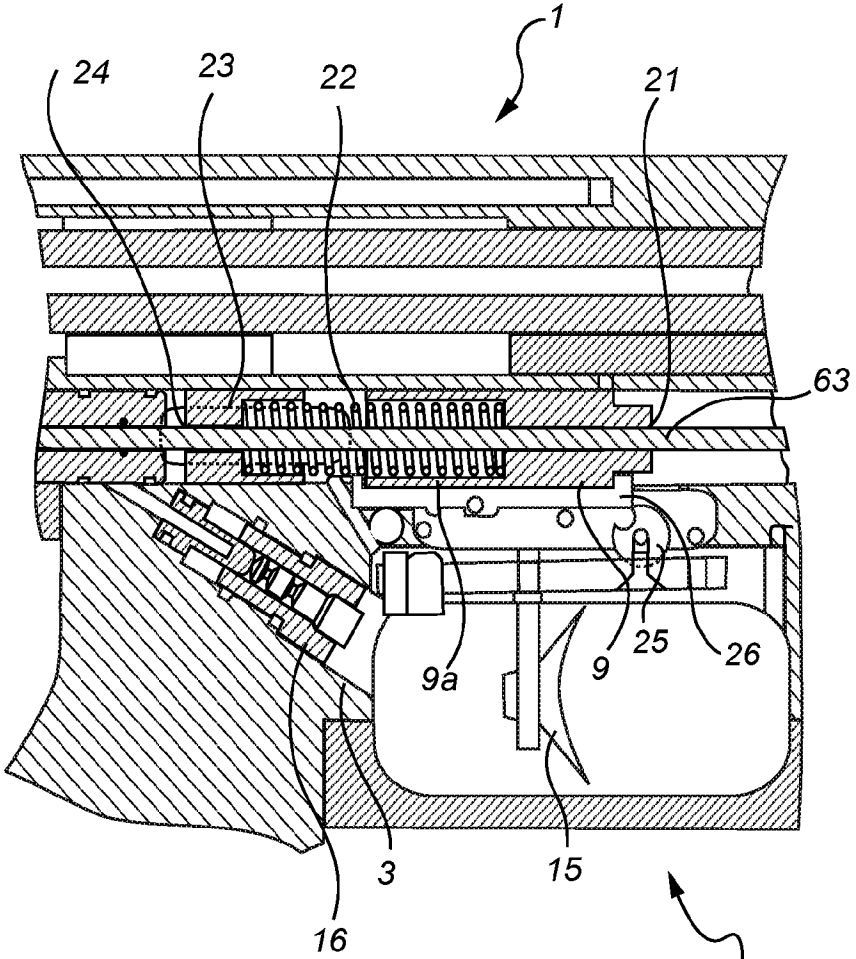
FIG. 3*a* is a more detailed cross section of the middle portion of the gun in FIG. 1*a*.
Figure 4:
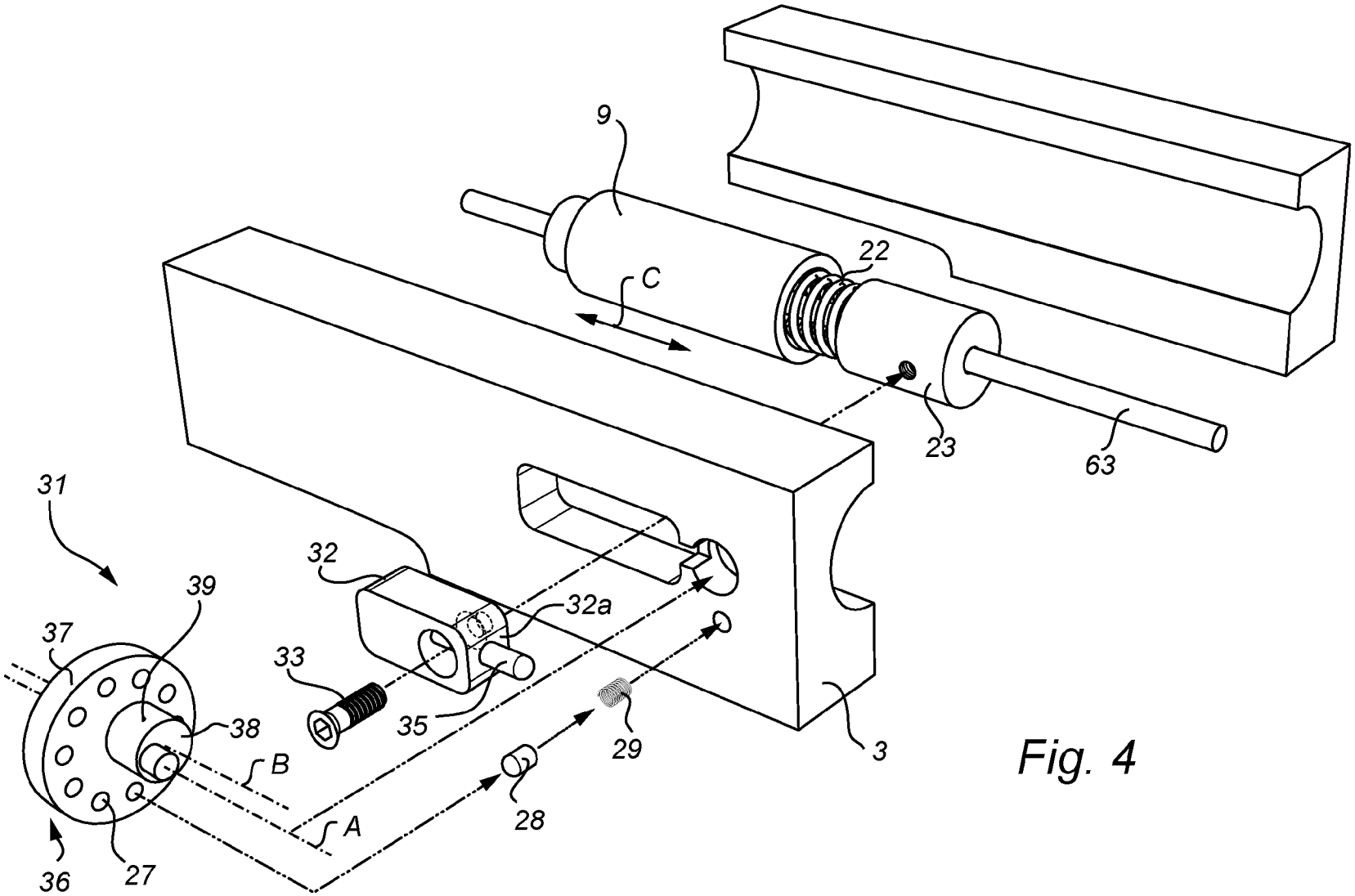
FIG. 4 is an exploded view of the bullet velocity regulator arrangement in FIG. 3*a*-3*b*.

The gun is here further provided with a velocity regulator arrangement 31, shown partly in FIG. 3*b* and in more detail in FIG. 4, which is arranged to allow a user to adjust the velocity of a bullet leaving the gun.

The arrangement 31 comprises a follower 32 attached to the spring abutment 23 by means of a screw 33. The follower 32 has a threaded bore 34, in which a threaded pin 35 is engaged. The bore 34 extends in the spring loading direction and the pin 35 protrudes on the front side 32*a* of the follower 32. The arrangement 31 further comprises an adjustment knob 36, rotatably arranged in the body 3 of the gun immediately in front of the follower 32. The knob 36 has a gripping portion 37 to enable a user to turn the knob 36 around an axis A, which is perpendicular to the spring loading direction C. The knob 36 further has a cylindrical portion 38, arranged with its centre axis B parallel to axis A but offset with respect to axis A. As a result, different parts 39*a*, 39*b* of the mantle surface 39 of the portion 38 will be at different distances to the axis A. It is noted that the offset of the axis should be smaller than the radius of the cylindrical portion 38.

The follower 32 and the knob 36 are oriented such that the follower 32 can slide in the spring loading direction C and the pin 36 can be brought into contact with the cam surface 39. The spring 22 will press the abutment 23, and thus the follower 32, against the cam surface 39.

Figure 5A:
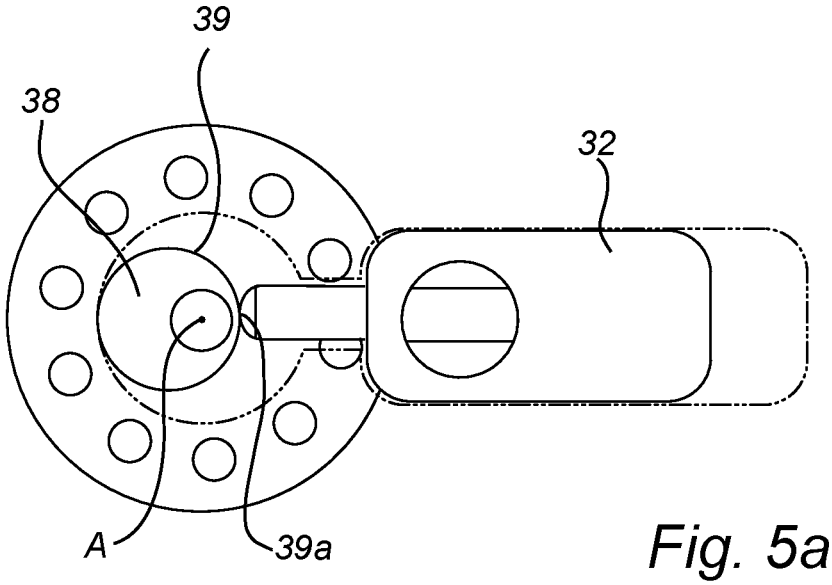
FIGS. 5*a* and 5*b* are plane views showing the operation of selected parts of the velocity regulator in FIG. 4.
Figure 5B:
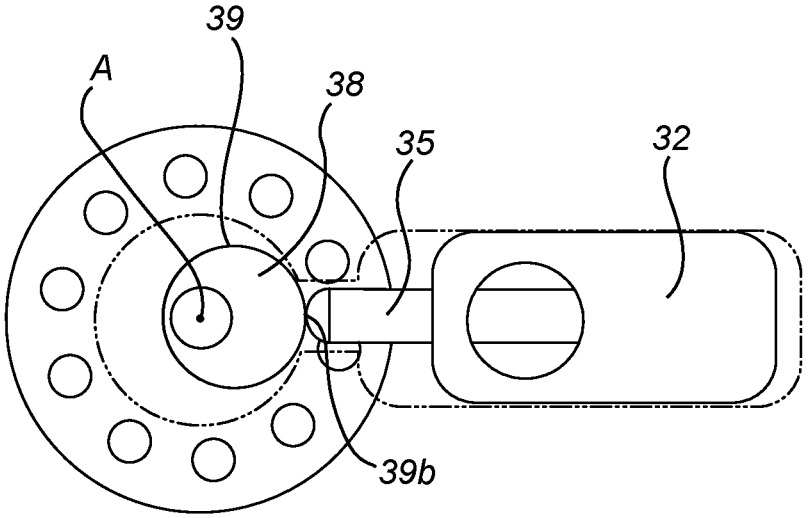

As illustrated in FIGS. 5*a* and 5*b*, the rotational position of the knob 36 will change the position of the follower 32, and thus the spring abutment 23. FIG. 6A shows the follower more forward (left in the figure) while FIG. 6B shows the follower more rearward (right in the figure).

In FIG. 5*a*, the knob 36 is arranged such that the surface 39*a* of the cylindrical portion facing the follower 32 is close to the axis A. The pin 36 of the follower 32, which rests against the cam surface 39*a*, is therefore in a forward position.

In FIG. 5*b*, the knob 36 has been turned 180 degrees, so that the surface 39*b* of the cylindrical portion facing the follower 32 is more distant from the axis A. The pin 36 of the follower 32, which here rests against the cam surface 39*b*, is therefore in a rearward position.

It is noted that the position of the pin 35 of the follower 32 will determine the exact position of the spring abutment 23 when the follower 32 abuts the cam surface 39. The velocity regulator may thus be calibrated by turning the pin 35 in its threaded hole. Such calibration s typically only required during manufacturing or service of the gun.

Returning to FIG. 4, the knob 36 is formed with a plurality of indentations 27 in the surface facing the body 3 of the gun. Further, a small pin 28, or ball, is arranged in a groove or hole in the body 3, and spring loaded by a spring 29 against the knob 36. The pin 28 is pressed by the spring 29 into the indentation 27, thereby locking the knob 36 in a predefined position. When the knob is turned, the rounded surface of the pin will slide out of the indentation and then against the surface of the knob until it engages another one of the indentations. In this way, the knob can be locked in one of a plurality of predefined positions.

The effect of turning the knob 36 to the position in FIG. 6A, is that the follower 32, which is attached to the spring abutment 23, will pull the spring abutment forward, thus compressing the spring 22. The spring loading of the hammer 9, and thus the impact of the hammer 9 on the hammer cooperating member 68, will then be stronger. With a stronger impact, the valve 60 will stay open a little longer, allowing more gas to flow into the discharge chamber 11, and thereby increasing the velocity of the bullet 12.

The person skilled in the art realizes that the present invention by no means is limited to the preferred embodiments described above. On the contrary, many modifications and variations are possible within the scope of the appended claims. For example, the valve head and hammer, which have been described as being located in front of the valve seat, may instead be located behind the valve seat, in a more conventional manner. In that case, the hammer may impact directly on the valve head, and push the valve open. The placement of the valve head, the hammer, the trigger and other elements of the gun will not affect the principles of the present invention, related to a novel velocity regulation arrangement.

What is claimed is:

1. A gas powered gun for discharge of projectiles, comprising:

a valve arranged to exhaust compressed gas from a pressure chamber to thereby discharge a projectile inside a barrel;

a hammer;

a movable spring abutment;

a spring arranged between said hammer and said spring abutment and arranged to spring load said hammer in a spring loading direction;

an adjustment knob including:

a gripping portion, allowing a user to grip said adjustment knob and to turn said adjustment knob around an axis (A) of rotation, said axis of rotation being substantially perpendicular to said spring loading direction, a cam surface extending around said axis of rotation and having a varying radial distance from said axis of rotation; and a follower, coupled with said spring abutment and pressed by said spring in said spring loading direction to rest against said cam surface;

so that, when said adjustment knob is turned, said follower will slide against said cam surface and move said follower and said spring abutment in said spring loading direction, to thereby adjust a pretension of said spring.

2. The gun according to claim 1, wherein said follower and said spring abutment are attached to each other by a screw.

3. The gun according to claim 1, wherein said follower and said spring abutment are formed as separate parts and fixedly attached to each other.

4. The gun according to claim 1, wherein said knob is arranged so as to be accessible from outside the gun.

5. The gun according to claim 1, wherein said knob comprises a cylindrical portion formed with a center axis (B) in parallel and at a distance from the axis (A), and wherein said cam surface is formed by a mantle surface of said cylindrical portion.

6. The gun according to claim 1, wherein said knob is lockable in predefined positions, each position associated with a specific portion of the cam surface facing the follower, each cam surface portion having a specific distance to the axis (A).

7. The gun according to claim 1, wherein said follower further comprises a threaded pin mounted in a threaded bore formed in the spring loading direction, the threaded pin being arranged to abut said cam surface, so that a relative position of the threaded pin with respect to the threaded bore will determine an exact position of the follower and the spring abutment.

8. The gun according to claim 1, wherein said valve is arranged in a rear end of said pressure chamber.

9. The gun according to claim 8, wherein said valve comprises a valve seat and a valve head adapted to sealingly abut said valve seat to close said valve, said valve head being provided in a rear end of an elongated extension member, wherein a hammer cooperating member is provided in a front end of said elongated extension member, wherein said hammer is arranged between said valve head and said hammer cooperating member, so that, when said hammer is moved in the firing direction into contact with said hammer cooperating member, said hammer cooperating member pulls said valve head out of contact with said valve seat, thereby bringing said valve to its open state.

10. The gun according to claim 9, wherein said hammer is arranged between said pressure chamber and said hammer cooperating member.

* * * * *